US006827791B2

(12) United States Patent
Ruffa et al.

(10) Patent No.: US 6,827,791 B2
(45) Date of Patent: Dec. 7, 2004

(54) METHOD FOR REMOVING PAINT FROM A SUBSTRATE

(75) Inventors: Anthony A. Ruffa, Hope Valley, RI (US); Sameer I. Madanshetty, Manhattan, KS (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/267,886

(22) Filed: Oct. 8, 2002

(65) Prior Publication Data

US 2004/0065343 A1 Apr. 8, 2004

(51) Int. Cl.[7] ..... B08B 1/00; B08B 6/00

(52) U.S. Cl. ..... 134/1; 134/6; 134/38; 134/32; 134/42; 15/97.1

(58) Field of Search ..... 134/1, 6, 11, 31, 134/34, 32, 38, 42, 184; 15/97.1, 98

(56) References Cited

U.S. PATENT DOCUMENTS

| | | | | | |
|---|---|---|---|---|---|
| 5,681,396 | A | * | 10/1997 | Madanshetty | 134/1.3 |
| 6,395,096 | B1 | * | 5/2002 | Madanshetty | 134/1 |
| 2002/0121292 | A1 | * | 9/2002 | Betrabet et al. | 134/34 |

* cited by examiner

*Primary Examiner*—Zeinab El-Arini
(74) *Attorney, Agent, or Firm*—James M. Kasischke; Micheal F. Oglo; Jean-Paul A. Nasser

(57) ABSTRACT

A method for removing paint from a substrate includes the steps of providing a sponge having a first surface for contact with the substrate, providing ultrasonic transducers in contact with a second surface of the sponge opposite from the first surface, saturating the sponge with water to provide a path of water extending from the transducers to the substrate, and activating the transducers to generate (i) a low frequency acoustic field; and (ii) a high frequency acoustic field; and thereby (iii) micron-sized vapor or cavitation bubbles which impinge upon the paint on the substrate to remove the paint from the substrate.

8 Claims, 1 Drawing Sheet

METHOD FOR REMOVING PAINT FROM A SUBSTRATE

STATEMENT OF GOVERNMENT INTEREST

The invention described herein may be manufactured and used by and for the Government of the United States of America for Governmental purposes without the payment of any royalties thereon or therefor.

CROSS REFERENCE TO OTHER PATENT APPLICATIONS

Not applicable.

BACKGROUND OF THE INVENTION (1) Field of the Invention

The invention relates to the removal of coatings, such as paint, from a substrate and is directed more particularly to removal of paint, or other such coatings, in air, without damage to the substrate.

(2) Description of the Prior Art

It is known to remove paint from substrates by utilizing ultrasonic fields to produce micron-sized vapor (or cavitation) bubbles which impinge against the paint. The microcavitation allows for removal of the paint from the substrate without damaging the substrate. This is taught by U.S. Pat. No. 5,681,396. Inasmuch as micron-sized cavitation bubbles are used to remove the coating, the process works well underwater. However, to adapt the process to surfaces in the air requires the application of water, as by jets of water, to immerse the coated surface. In such procedures, the amount of water required is quite large and the used water is contaminated with the removed paint or other coating material, all hereinafter referred to as "paint".

There is thus a need for a method for acoustic cavitation-based paint removal in air, wherein the substrate is not damaged by the cavitation, a relatively small quantity of water is required, and the contaminated water run-off is minimal.

SUMMARY OF THE INVENTION

An object of the invention is, therefore, to provide a method for removing paint from a substrate without damage to the substrate.

A further object of the invention is to provide such a method wherein an acoustic field causes formation of micron-sized vapor or cavitation bubbles which are impinged upon the paint surface to cause removal of paint therefrom, wherein the process requires relatively small quantities of water and produces a relatively small run-off of contaminated water.

With the above and other objects in view, as will hereinafter appear, a feature of the present invention is the provision of an apparatus and method for removing paint from a substrate disposed in air. The apparatus includes a sponge capable of having a fluid therein. The sponge has a first surface that can be placed in contact with the coating. High and low frequency transducers are positioned in contact with the second surface of the sponge. Activation of the transducers generates cavitation at the surface of the coating for removing the coating.

The method includes the steps of providing a sponge having a first surface for contact with the substrate, providing ultra sonic transducers in contact with a second surface of the sponge opposite from the first surface, saturating the sponge with water to provide a path of water extending from the transducers to the substrate, and activating the transducers to generate (i) a low frequency acoustic field; and (ii) a high frequency acoustic field; and thereby (iii) micron-sized vapor (or cavitation) bubbles which impinge upon the paint on the substrate to remove the paint from the substrate as taught by U.S. Pat. No. 5,681,396.

The above and other features of the invention, including various novel details of construction and combinations of steps, will now be more particularly described with reference to the accompanying drawings and pointed out in the claims. It will be understood that the particular method embodying the invention is described by way of illustration only and not as a limitation of the invention. The principles and features of this invention may be employed in various and numerous embodiments without departing from the scope of the invention.

BRIEF DESCRIPTION OF THE DRAWING

Reference is made to the accompanying drawing in which is shown an illustrative embodiment of the invention, from which its novel features and advantages will be apparent, and wherein.

DESCRIPTION OF THE PREFERRED EMBODIMENT

Figure 1:
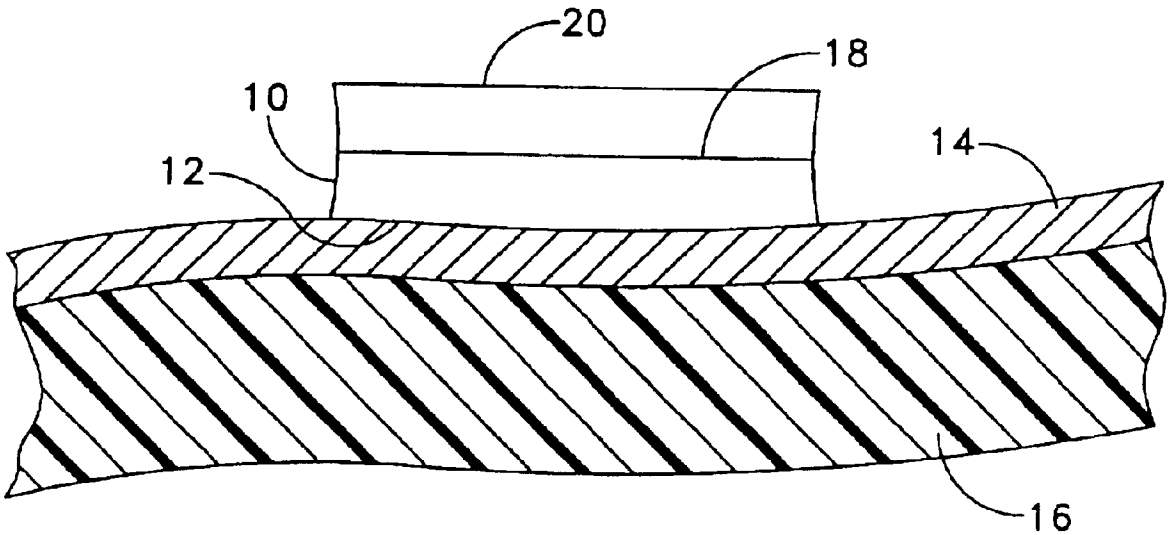
FIG. 1 is a diagrammatic side elevational, partly sectional, view illustrating one form of apparatus for effecting an embodiment of the invention.

Referring to FIG. 1, it will be seen that there is provided a sponge 10 having a first surface 12 for contact with a coating 14 of paint, or the like, which is desired to be removed from a substrate 16 which is disposed in a non-underwater environment. The sponge 10 can be made from any porous elastic material including but not limited to cellulose, neoprene, foam rubber, natural fiber or the like. While virtually any substrate material may be stripped of a coating by the method presented herein, it will be appreciated that the method finds particular applicability to substrates, such as fiber/epoxy components, which are easily damaged by conventional paint removal methods.

An array 20 of transducers is provided in contact with a second surface 18 of the sponge 10 opposite from the sponge first surface 12. The array 20 includes at least one high frequency transducer and at least one low frequency transducer. The high frequency transducer preferably produces an acoustic field of about 25–35 MHz and the low frequency transducer preferably produces an acoustic field of about 1–3 MHz.

The sponge 10 is saturated with water to provide a path of water extending from the transducers 20 to the paint 14. The sponge preferably exhibits a specific acoustic impedance substantially equal to the specific acoustic impedance of water.

The array of transducers 20 is then activated, preferably in a pulsing fashion, though continuous operation performs acceptably. The simultaneous use of the low and high frequency ultrasonic fields causes the formation of micron-sized cavitation bubbles which live for only a few microseconds, but in that time are caused to impinge upon the paint 14 and dislodge micro particles of paint which are absorbed into the sponge 10 and/or are carried from the sponge in water run-off.

Inasmuch as the water run-off is minimal, there is very little water contaminated with paint and requiring disposal.

To encourage faster cavitation, the sponge first surface 12 may be roughened and/or hardened, and/or may be rendered hydrophobic.

To remove paint from an area larger than the surface 12 of the sponge 10, the sponge and transducers 10, 20, may be held together and moved as a unit over the paint surface 14.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A method for removing paint from a substrate disposed in air, the method comprising the steps of:

providing a sponge having a first surface for contact with the substrate, wherein the sponge first surface is at least one of (i) roughened, (ii) hardened, and (iii) hydrophobic;

providing ultrasonic transducers in contact with a second surface of the sponge opposite from the first surface;

saturating the sponge with water to provide a path of water extending from the transducers to the substrate;

placing the first surface of the sponge in contact with the substrate; and activating the transducers to generate (i) a 1–3 MHz acoustic field; and (ii) a 25–35 MHz acoustic field; and thereby (iii) micron-sized vapor or cavitation bubbles which impinge upon the substrate to remove the paint from the substrate.

2. The method in accordance with claim 1 wherein the step of providing ultrasonic transducers comprises providing at least one high frequency transducer having a frequency range of 25–35 MHz and at least one low frequency transducer having a frequency range of 1–3 MHz.

3. A method for removing paint from a substrate disposed in air, the method comprising the steps of:

providing a sponge having a first surface for contact with the substrate;

providing ultrasonic transducers in contact with a second surface of the sponge opposite from the first surface;

saturating the sponge with water to provide a path of water extending from the transducers to the substrate;

placing the first surface of the sponge in contact with the substrate; and activating the transducers to generate (i) a 1–3 MHz acoustic field; and (ii) a 25–35 MHz acoustic field; and thereby (iii) micron-sized vapor or cavitation bubbles which impinge upon the substrate to remove the paint from the substrate; and moving the sponge and ultrasonic transducers along the substrate.

4. The method in accordance with claim 3 wherein the sponge first surface is at least one of (i) roughened (ii) hardened, and (iii) hydrophobic.

5. The method in accordance with claim 1 wherein the step of providing ultrasonic transducers comprises providing an array of ultrasonic transducers.

6. The method in accordance with claim 1 wherein the step of activating the transducers comprises pulsing the transducers.

7. The method in accordance with claim 1 wherein the step of providing a sponge comprises providing a sponge having a specific acoustic impedance substantially equal to the specific acoustic impedance of water when soaked with water.

8. The method in accordance with claim 1, wherein the substrate comprises a fiber/epoxy composite material.

* * * * *